US006484850B1

(12) United States Patent
Kobayashi et al.

(10) Patent No.: US 6,484,850 B1
(45) Date of Patent: Nov. 26, 2002

(54) ELEVATOR CONTROL PANEL DEVICE

(75) Inventors: Kiyoshi Kobayashi; Takashi Gotoh, both of Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/389,747

(22) Filed: Sep. 7, 1999

(30) Foreign Application Priority Data

Sep. 7, 1998 (JP) ..... 10-252672

(51) Int. Cl.[7] ..... B66B 7/00
(52) U.S. Cl. ..... 187/414
(58) Field of Search ..... 187/414, 395, 187/397; 49/394; 52/206, 656.1, 656.2, 656.4; 70/134; 292/165, 169, 173

(56) References Cited

U.S. PATENT DOCUMENTS

| | | | | | |
|---|---|---|---|---|---|
| 4,138,869 | A | * | 2/1979 | Pelcin | 292/173 X |
| 4,261,189 | A | * | 4/1981 | Brumfield, Jr. et al. | 49/394 X |
| 4,335,595 | A | * | 6/1982 | Swan et al. | 292/173 X |
| 5,592,780 | A | * | 1/1997 | Checkovich | 49/394 X |
| 5,785,363 | A | * | 7/1998 | Stopfer et al. | 292/165 |
| 5,829,554 | A | * | 11/1998 | Benson et al. | 187/414 |

FOREIGN PATENT DOCUMENTS

| | | | | | |
|---|---|---|---|---|---|
| JP | 2-95692 | A | * | 4/1990 | 187/414 |
| JP | 6-271220 | A | * | 4/1990 | 187/414 |
| JP | 2-127387 | A | * | 5/1990 | 187/336 |
| JP | 3-166181 | | * | 7/1991 | 187/414 |
| JP | 6-144725 | A | * | 5/1994 | 187/414 |
| JP | 6-166478 | A | * | 6/1994 | 187/414 |
| JP | 6-72669 | A | * | 3/1995 | 187/395 |

* cited by examiner

*Primary Examiner*—Eileen D. Lillis
*Assistant Examiner*—Thuy V. Tran
(74) *Attorney, Agent, or Firm*—Oblon, Spivak, McClelland, Maier & Neustadt, P.C.

(57) ABSTRACT

An elevator control panel device, including an elevator control panel disposed in a doorjamb forming an entrance to the elevator in a building, a panel door rotatably pivoted via a hinge at a hinge side of the panel door and providing access to the control panel, an automatic closing mechanism configured to force the panel door in the closing direction so as automatically to close the panel door when the panel door is open, and at least one lock provided for locking the panel door at an opposite side of the panel door opposite to the hinge side of the panel door, a first member mounted on the panel door, and a second member mounted on the doorjamb, the first member being configured to engage the second member in a locked state automatically upon closing of the panel door.

19 Claims, 7 Drawing Sheets

ELEVATOR CONTROL PANEL DEVICE

CROSS REFERENCE TO RELATED APPLICATION

This application claims benefit of priority to Japanese Patent Application No. JP10-252672 filed Sep. 7, 1998, the entire content of which is incorporated by reference herein.

BACKGROUND OF THE INVENTION

1. Field of the Invention

The present invention relates to an elevator control panel device, in particular, to an elevator control panel device allowing the safe and easy pursuit of the maintenance check.

2. Description of the Background

In a conventional elevator, a machine room (penthouse) is provided at the upper end on top of an elevator shaft of the building wherein a cage ascends and descends. Provided in the machine room is a drive unit for the ascending and descending movement of the cage, and a control panel for controlling the elevator.

However, in the conventional configuration with the machine room provided at the upper end part of the shaft, the building height is increased due to the existence of the machine room, and thus it is disadvantageous in terms of the right of sunshine, the building capacity, and the like. That is, the machine room projects above the rooftop of the building, for example, possibly resulting in an infringement of the right to sunlight. Therefore, a machine-roomless elevator without a machine room installed at the upper end part of the shift, but wherein the drive unit and the control panel is installed in part of the space in the shaft, has been recently adopted.

While a doorjamb forming the entrance for the cage is provided on each floor of the building provided with the elevator, the conventional elevator is provided with a control panel, for controlling the elevator, inside the doorjamb of the hall of the uppermost floor in the machine-roomless elevator. Moreover, a rotatable panel door for opening/closing the front side of the control panel is provided at the inside front side of the doorjamb. A locking mechanism is provided in the panel door. At the time of a maintenance check, a maintenance worker unlocks the locking mechanism so as to open the panel door for operating the control panel.

However, the worker possibly may be interrupted during the performance of maintenance and may need to leave the control panel unattended. If the panel door then remains open while unattended, there is a risk of an accident by the intentional or inadvertent operator of the control panel by a third person other than the maintenance worker, and thus it is preferably for safety purposes that the panel door is always maintained in the closed state except during the time that the maintenance worker actually operates the control panel.

The doorjamb provided in the elevator hall, in general, has a height exceeding 2 m. Therefore, the panel door to be provided inside the doorjamb has a longitudinal shape with a large vertical span. However, in the conventional configuration, a part of the panel door is locked with the locking mechanism.

Moreover, the locking mechanism has a function of engaging and supporting the panel door mechanically, in addition to the function of prohibiting opening of the panel door. However, in the conventional configuration, since a locking mechanism is provided only in a part of the panel door, if the panel door is in the locked state and is opened by force or handled violently, distortion or deformation is generated between the upper and lower parts of the panel door.

SUMMARY OF THE INVENTION

An object of the present invention is to provide an elevator control panel device with reduced risk of an accident by the intentional or inadvertent operation of the control panel by a third person other than the maintenance worker.

This and other objects are achieved by providing a new and improved elevator control panel device, including an elevator control panel disposed in a doorjamb forming an entrance to the elevator in a building, a panel door rotatably pivoted via a hinge at a hinge side of the panel door and providing access to the control panel, an automatic closing mechanism configured to force the panel door in the closing direction so as automatically to close the panel door when the panel door is open, at least one lock provided for locking the panel door at an opposite side of the panel door opposite to the hinge side of the panel door, including a first member mounted on the panel door, and a second member mounted on the doorjamb, the first member being configured to engage the second member in a locked state automatically upon closing of the panel door.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
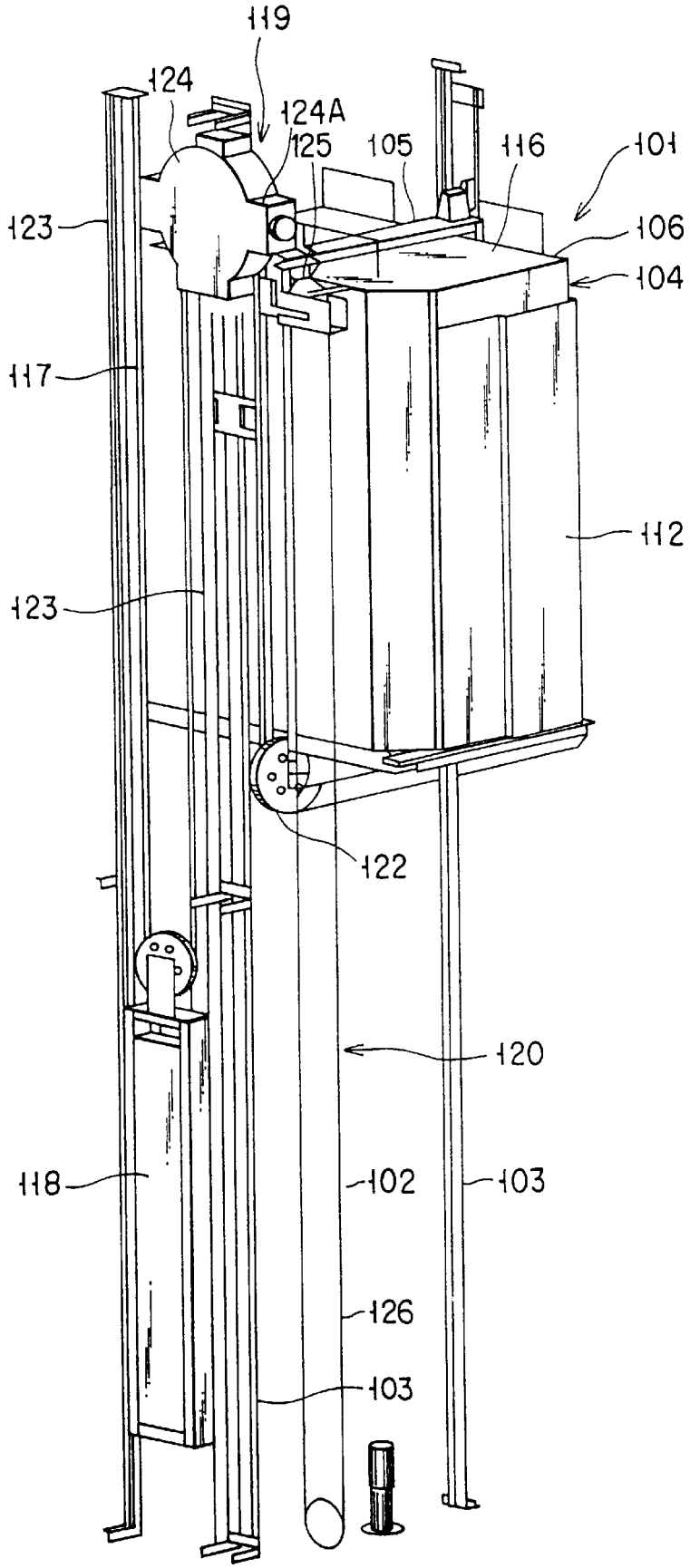
FIG. 1 is a schematic perspective view of a machine-roomless elevator.

Referring now to the drawings, wherein like reference numerals designate identical or corresponding parts throughout the several views and more particularly to FIG. 1 thereof, FIG. 1 shows a machine-roomless elevator of a first embodiment of the present invention.

The machine-roomless elevator shown in FIG. 1 dispenses with the machine room by installing a control panel in the vicinity of the depot in the elevator hall or on an elevator cage and storing a drive unit at the uppermost part or the lowermost part of the shaft. In FIG. 1, the drive unit 124 is placed on and fixed with a drive unit mounting base 124A to the uppermost part of a guide rail 123.

As shown in FIG. 1, an elevator 101 includes a plurality of guide rails 103, 123 to be provided in the elevator shaft 102 in a building, a cage 104, a cable 117, a counter weight 118, a driving mechanism 119 and an emergency stop mechanism 120.

The guide rails 103 are provided in the elevator shaft 102 of the building substantially in parallel with each other along the shaft 102. In the embodiment shown in FIG. 1, a pair of the guide rails 103 is provided.

The cage 104 includes a cage frame 105 and a cab 106 for accommodating a passenger. The cage frame 105 is interposed between the parallel guide rails 103, 103.

The cab 106 includes a cage floor, a front wall having an opening and closing door 112 facing to the hall, a pair of side plates connected with right and left end parts of the front wall, a rear plate connecting the pair of the side plates and parallel with the front wall, and a ceiling plate 116. The cage 104 is supported by rotatable car sheaves 122, 122 at the lower side thereof. The car sheaves 122, 122 are wound around by the cable 117.

The cable 117, made of metal, is attached at one end to the upper end part of one of the above-mentioned pair of the guide rails 103, 103, and to the upper end part of one of the counter weight guide rails 123, 123 later described by at its other end. The cable 117 is placed around the car sheaves 122, 122 for suspending the cage 104 in the elevator shaft 102 of the building along the guide rails 103, 103.

The counter weight 118 is vertically movable along the pair of the counter weight guide rails 123, 123 provided along one of the guide rails 103 and is suspended by the cable 117. The counter weight 118 balances the cage 104 via the cable 117 when a certain number of passengers enter the cab 106 of the cage 104.

The driving mechanism 119 includes a traction sheave (not illustrated) around which the cable 117 is wound and a drive unit 124 for rotating the traction sheave. The driving mechanism 119 moves the cage 104 vertically along the guide rails 103, 103 via the cable 117 by rotating the traction sheave with the drive unit 124.

The emergency stop mechanism 120, such as disclosed in U.S. Pat. No. 5,377,786, includes a governor device 125 and a speed governor rope 126 partially connected to the cage 104. The emergency stop mechanism 120 immediately stops the cage 104 automatically by constraining the speed governor rope 126 when the cage 104 falls at a rate higher than the rated speed.

Figure 2:
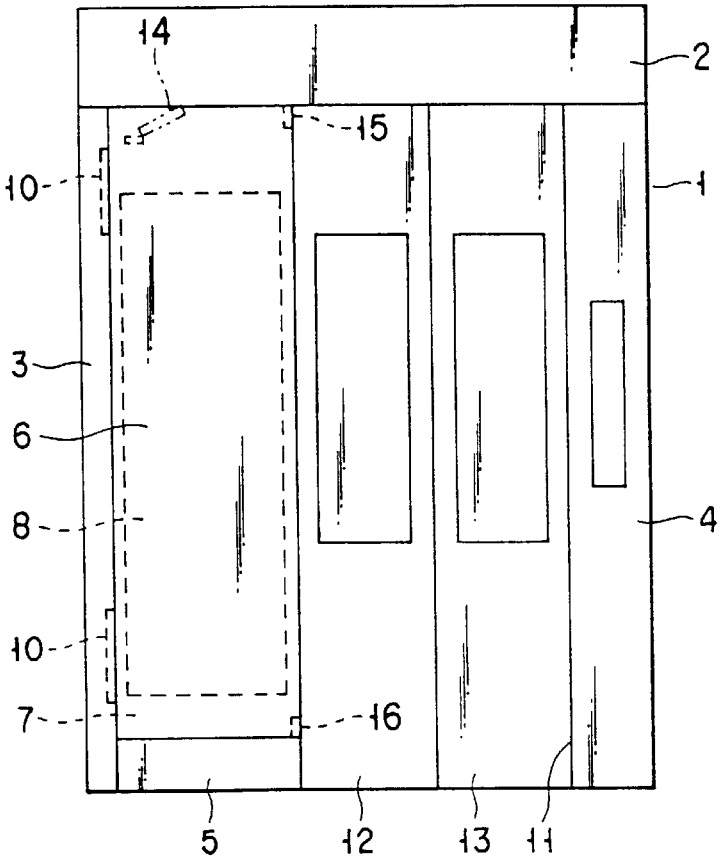
FIG. 2 is a front view of one embodiment of the present invention.
Figure 3:
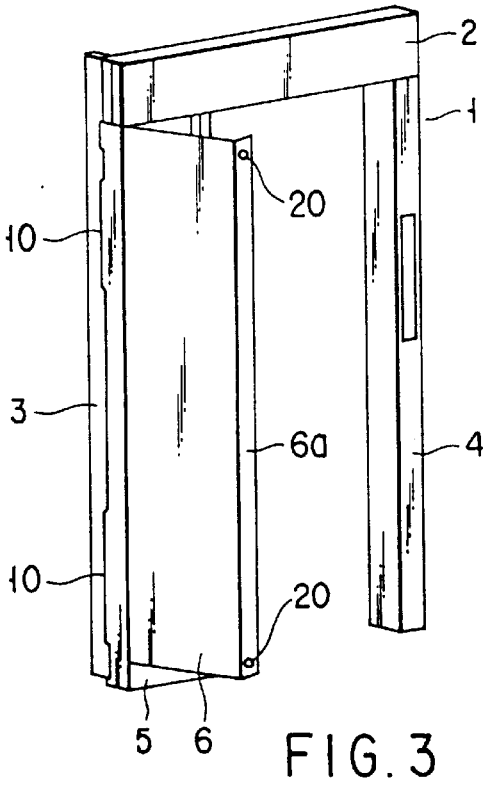
FIG. 3 is a perspective view of the same embodiment.

FIGS. 2 and 3 show a doorjamb 1 serving as the frame of the elevator entrance provided in the elevator hall of the building. The doorjamb 1 includes a ceiling beam 2 and a pair of side beams 3, 4 extending downward from both ends of the ceiling beam 2 so as to form a gate-like shape, with a horizontal beam 5 provided integrally with the lower end part of the one side beam 3.

A panel door 6 is provided inside the one side beam 3. Behind the panel door 6 is a control panel installing part 7 in which a control panel 8 for controlling the elevator is placed. The panel door 6 is placed between the ceiling beam 2 of the doorjamb 1 and the horizontal beam 5 such that the panel door 6 is pivoted rotatably via hinges 10 at one side thereof for opening/closing and providing access to the front side of the above-mentioned control panel 8. The space between the panel door 6 and the other side beam 4 of the doorjamb 1 forms an entrance opening 11 for the cage of the elevator, with entrance doors 12, 13 provided at the entrance opening 11.

Figure 4:
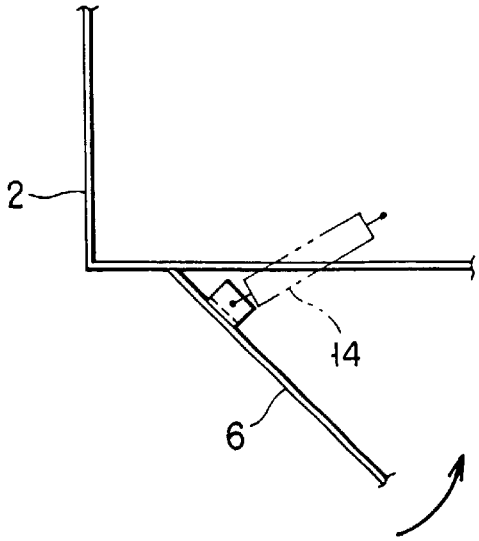
FIG. 4 is a plan view of an automatic opening and closing means of a panel door.
Figure 5:
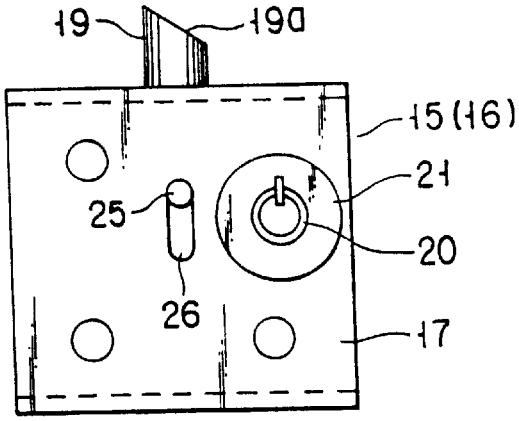
FIG. 5 is a front view of a locking mechanism.

As shown in FIGS. 2 and 4, an extension spring 14 is mounted between the rear side of the panel door 6 and the ceiling beam 2 for automatically closing the panel door 6. Further, locking mechanisms 15, 16 are provided at the upper and lower parts of the side of the panel door 6 opposite the hinge 10, that is, on the free end side. The locking mechanisms 15, 16 have a size smaller than the thickness of the panel door 6. For example, "Latch Lock", which is a product name and sold by Tochigi-ya Corporation, can be used as the lock mechanisms 15,16.

As shown in FIGS. 5 to 9, the locking mechanisms 15, 16 include a C-shaped frame 17, a rod 18 provided inside the frame 17 and a lock pin 19 connected with the rod 18, a key body 21 having a key hole 20, mounted with the frame 17, and the connecting pin 25 for moving the rod 18 and the lock pin 19 back and forth in the axial direction according to the operation of the key to be inserted into the key hole 20 of the key body 21.

Figure 7:
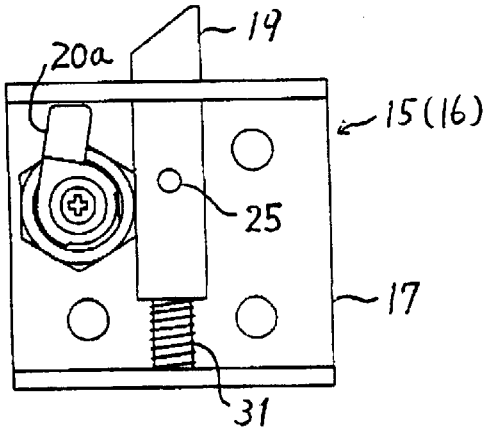
FIG. 7 is a rear view of the locking mechanism in a locking state.
Figure 8:
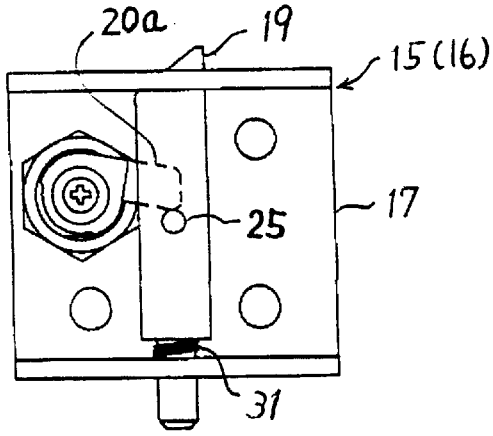
FIG. 8 is a rear view of the locking mechanism in an open state.

The locking mechanisms 15,16 can be set in the open state or the closed state by inserting the key into the key hole 20 and turning the key by 90 degrees. As shown in FIGS. 7 and 8, at the time of the open operation, with the rotation of the key, a lever 20*a* is turned and pushes the interlocking member 23, thereby retracting the pin 19. The open state can be maintained by pulling the key out a short distance with the key turned by 90 degrees. At this time, the key is still left in the key hole 20. A pin (not shown) is installed on the bottom of the key hole 20. When the key is fully inserted into the key hole 20, the pin (not shown) is pushed thereby enabling the key to rotate. If the key is pulled out by the short distance after turning by 90 degrees in order to be in the open state, the pin (not shown), which is spring biased, returns back and the key is restricted its rotation. Thus, the pin 19 remains retracted in spite of a righting force of a coil spring 31, and the locking mechanisms 15,16 is maintained to be in the open state.

Figure 10:
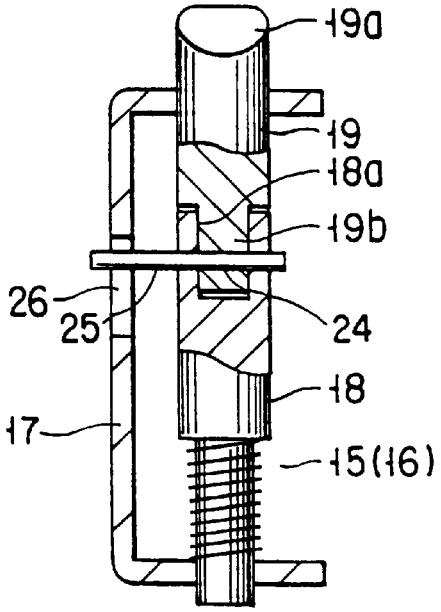
FIG. 10 is a side view, partly in cross section, of a part of the locking mechanism.
Figure 9:
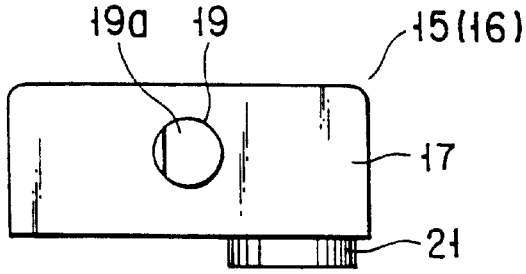
FIG. 9 is a plan view of the locking mechanism.

The lock pin 19 projects outward from one side part of the frame 17, with the projecting end cut into an inclined surface 19*a* inclined in one direction. As shown in FIG. 10, the other end of the lock pin is a small diameter shaft part 19*b*, with a through hole 24 formed therein.

The small diameter shaft part 19*b* is fitted freely in a fitting hole 18*a* formed in the rod 18. A connecting pin 25 is inserted removably into the through hole 24 of the small diameter shaft part 19*b* from the outside of the rod 18 so that the rod 18 and the lock pin 19 are interlocked with each other by the connecting pin 25.

The end part of one end side of the connecting pin 25 is fitted freely in a long hole-shaped guide hole 26 formed at the front side of the frame 17. By pulling out the connecting pin 25, rotating the lock pin 19 by 180 degrees around its longitudinal axis and inserting the connecting pin 25 into the through hole 24 again, the orientation of the inclined surface 19*a* at the tip of the lock pin 19 can be inverted.

Figure 11:
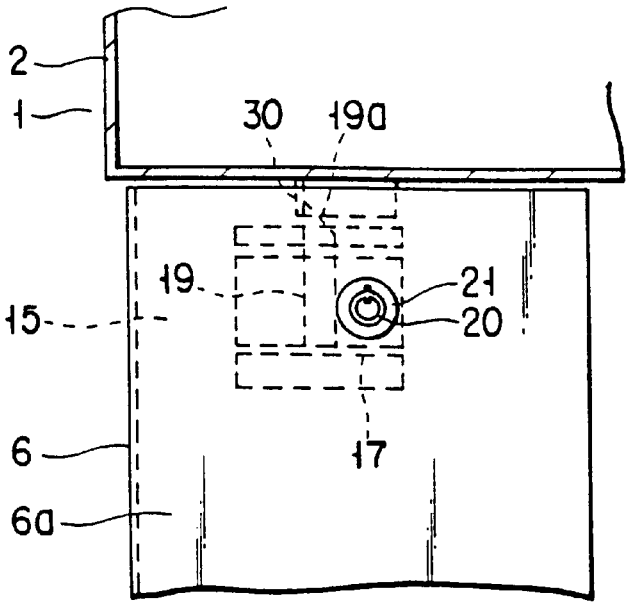
FIG. 11 is a front view of a mounting structure of the locking mechanism with respect to the upper side of the panel door.
Figure 12:
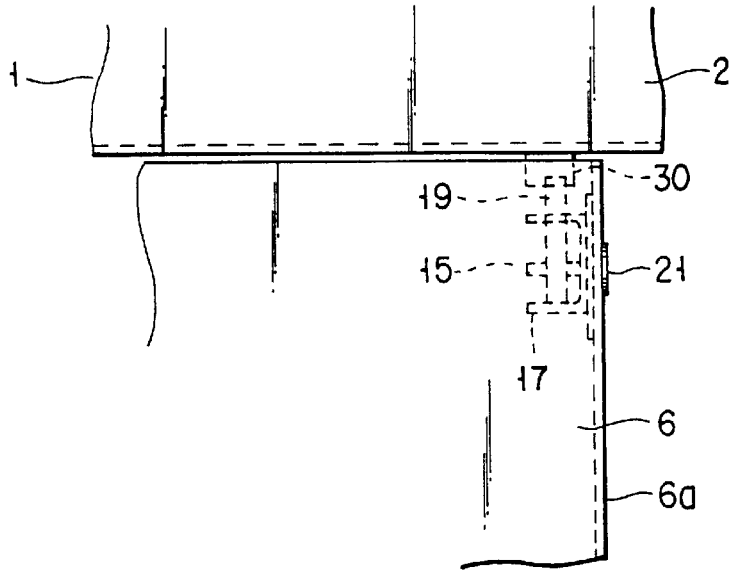
FIG. 12 is side view of the mounting structure of the locking mechanism with respect to the upper side of the panel door.
Figure 13:
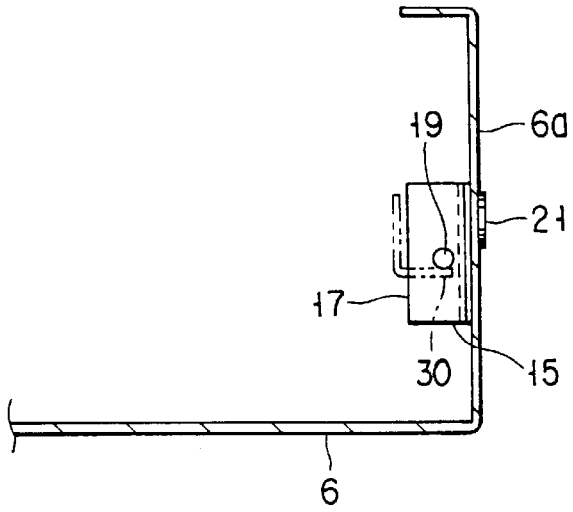
FIG. 13 is a plan view of the mounting structure of the locking mechanism with respect to the upper side of the panel door.
Figure 15:
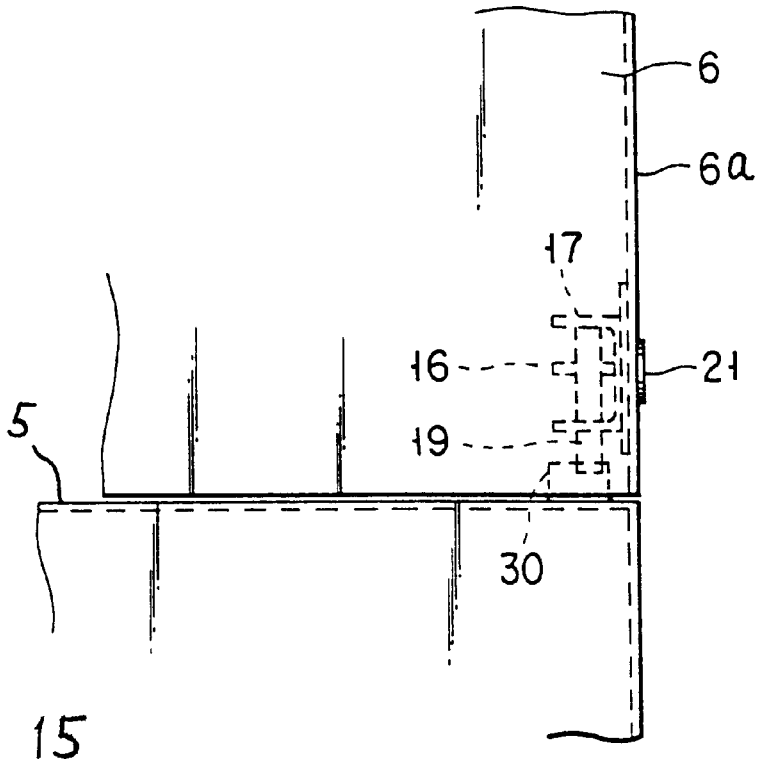
FIG. 15 is a side view of the mounting structure of the locking mechanism with respect to the lower side of the panel door.
Figure 16:
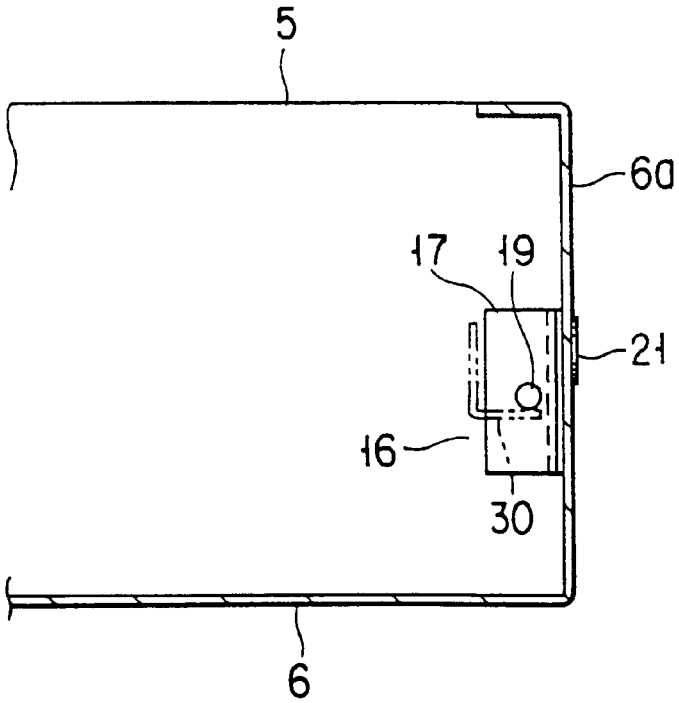
FIG. 16 is a plan view of the mounting structure of the locking mechanism with respect to the lower side of the panel door.

The panel door 6 at the side opposite to the hinges 10 has a side plate 6*a* bent to the rear side thereof and provided with the above-mentioned locking mechanisms 15, 16. The mounting structure of one locking mechanism 15 provided at the upper side of the panel door 6 is shown in FIGS. 11 to 13, and the mounting structure of the other locking mechanism 16 is shown in FIGS. 14 to 16, respectively.

The one locking mechanism 15 is mounted such that the frame 17 contacts with the inner surface of the side plate 6*a*, the key hole 20 of the key body 21 is exposed to the outer surface of the side plate 6*a*, with the end face of the key body 21 piercing through the side plate 6*a*, and the lock pin 19 projects upward, with the inclined surface 19*a* formed at the tip thereof facing to the rear side of the doorjamb 1. An L-shaped engaging member 30 is mounted to the lower surface of the ceiling beam 2 of the doorjamb 1, independently from the doorjamb 1, with the lock pin 19 detachably engaged with the engaging member 30.

Figure 14:
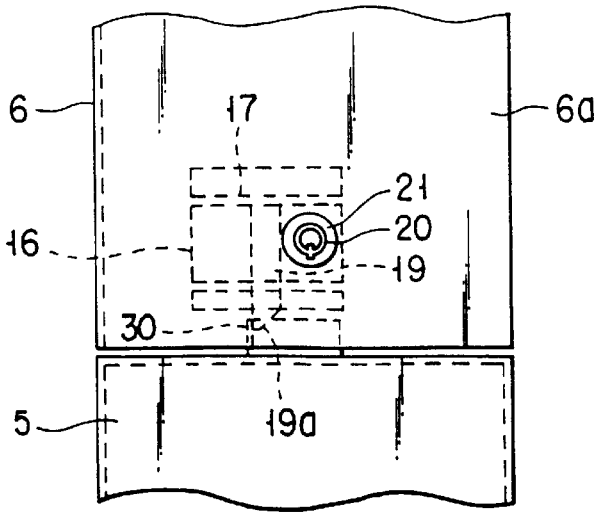
FIG. 14 is a front view of a mounting structure of the locking mechanism with respect to the lower side of the panel door.

The other locking mechanism 16 as shown in FIG. 14 is mounted such that the frame 17 contacts the inner surface of the side plate 6*a*, the key hole 20 of the key body 21 is exposed to the outer surface of the side plate 6*a*, with the end face thereof piercing through the side plate 6*a*, and the lock pin 19 projects downwardly, with the inclined surface 19*a* formed at the tip thereof facing to the rear side of the doorjamb 1. An L-shaped engaging member 30 is mounted to the upper surface of the horizontal beam 5 provided below the panel door 6, independently from the horizontal beam 5, with the lock pin 19 detachably engaged with the engaging member 30.

The mounting state of the one locking mechanism 15 at the upper part of the panel door 6 and that of the other locking mechanism 16 at the lower part of the panel door 6 are inverted with respect to the upper and lower direction, and thus the orientation of the inclined surfaces 19*a* of the lock pins 19 are inverted with respect to the front and rear direction. However, since the orientation of the inclined surface 19*a* can be inverted to the opposite direction by pulling out the connecting pin 25 and rotating the lock pin 19 as mentioned above, the inclined surface 19*a* of the lock pin 19 of the one locking mechanism 15 and the inclined surface 1 9*a* of the lock pin 19 of the other locking mechanism 16 can be oriented in the same direction, that is, toward the rear side of the doorjamb 1, and thus the same parts can be used commonly for both locking mechanisms 15, 16.

When the locking mechanisms 15, 16 are in the locked state, the locking pin 19 is engaged with the inner side of the engaging member 30. By inserting the key into the key hole 20 in the locked state, and rotating the key in one direction for the opening operation, the lock pin 19 is retracted by a predetermined stroke so as to be detached from the engaging member 30. Then, the opened state can be maintained by pulling the key out a short distance. On the other hand, by rotating the above-mentioned key in the opposite direction from the opened state for the locking operation, the lock pin 19 is moved outward by a predetermined stroke so as to be engaged with the engaging member 30. Then, the locked state can be maintained again.

Figure 6:
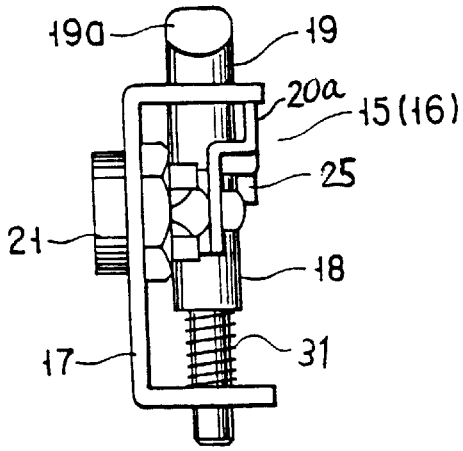
FIG. 6 is a side view of the locking mechanism.

In particular, as shown in FIG. 6, in the locking mechanism 15 provided at the upper side of the panel door 6, a coil spring 31 is provided at the outer periphery of the rod 18 such that the lock pin 19 is always biased in the outward (upward) direction by the coil spring 31. An automatic locking structure is provided such that in the state where the lock pin 19 is at the fully extended outward position by a predetermined stroke by the locking operation with the key, if a longitudinal pushing force acts on the lock pin 19 via the inclined surface 19*b*, the lock pin 19 is moved downward independently of the key operation, overcoming the bias provided by the above-mentioned coil spring 31. If the pushing force is released, the lock pin 19 is moved outward again by the predetermined stroke by the biasing force provided by the coil spring 31.

The operation of this embodiment will be explained. Normally, the panel door is locked by the locking mechanisms 15, 16. In the locked state, the side plate 6*a* of the panels door 6 opposite the side with the hinge 10 is supported stably by the locking mechanisms 15, 16 at upper and lower points of the panel door, and thus, if the panel door 6 is forced opened or handled violently, it is less likely that the panel door 6 will be distorted or deformed.

Moreover, since the key hole 20 of each locking mechanism 15, 16 is exposed at the side plate 6*a* of the panel door 6, it can hardly be seen from the front side of the panel door. Therefore, the front surface of the panel door 6 viewed from the elevator hall is neat, and thus a preferred appearance can be achieved.

On the other hand, in the maintenance check of the elevator, a worker inserts the keys to the key hole 20 of the locking mechanisms 15, 16, respectively so as to rotate the keys for the opening operation. Then, the keys are pulled out by a short distance in order to maintain the open state. According to the opening operation, the lock pins 19 of the locking mechanisms 15, 16 are retracted from the position engaged with the engaging member 30 so as to release the engagement so as to be in the open state.

Therefore, by pulling the panel door 6 in the locking mechanism open state to the elevator hall side, to against the resistance of the extension spring 14, the panel door 6 can be opened. Then, the opened state of the panel door 6 can be maintained by the worker holding it by hand or body so as to operate the control panel 8 inside the doorjamb 1 in this state.

After operating the control panel 8, with the panel door 6 in the open state, the one locking mechanism 15 provided in the automatic locking structure is operated to be in the locked state by the key. According to this operation, the lock pin 19 of the one locking mechanism 15 is moved outward to the locked position. This operation can be conducted immediately after opening the panel door 6.

Thereafter, when the hand or the body is put off from the opened panel door 6, the panel door 6 automatically rotates in the closing direction by the force of the extension spring 14. At the time, according to the rotation in the closing direction of the panel door 6, the inclined surface 19*a* at the tip of the lock pin 19 contacts with the rim of the engaging 32 member 30 so that the lock pin 19 is moved backward, against the bias of the coil spring 31. When the lock pin 19 moves ahead of the rim of the engaging member 30, the lock pin 19 is moved outward again by the force of the coil spring 31 so that the lock pin 19 is engaged with the inner side of the engaging member 30, and the panel door 6 is automatically locked by the engagement. At the time, the other locking mechanism 16 is left in the open state by the preliminary key operation, so that its lock pin 19 is maintained at the retracted position, and thus it is maintained in the open state even if the panel door 6 is closed automatically.

At the time of an elevator maintenance check, the control panel 8 may need to be operated several times. However, if the panel door 6 is opened throughout the work, there is a risk of an unexpected accident by the intentional or inadvertent operation of the control panel 8 by a third person other than the maintenance worker, and thus it is preferable for safety purposes that the panel door 6 is maintained always in the closed state except during the time that the maintenance worker actually operates the control panel.

In the present invention, as mentioned above, after the operation of the control panel 8, the panel door 6 is closed automatically owing to the force by the extension spring 14 as an automatic closing means, and is locked automatically by the one locking mechanism 15. Therefore, except the time that the maintenance worker operates the control panel 8, the panel door 6 can always be maintained in the closed state to allow safe control.

Moreover, since the panel door 6 is closed automatically by the force of the extension spring 14, the risk of failure in closing can surely be prevented. Furthermore, since the automatically closed panel door 6 is locked automatically by the one locking mechanism 15, the panel door 6 cannot be opened by a third person inadvertently, and thus the safety can be reinforced.

In operating the control panel 8 by opening the panel door 6 again by the maintenance worker, the panel door 6 is opened by the opening operation of the one locked locking mechanism 15 with the key. At the time, since the other locking mechanism 16 is maintained in the open state, the open operation is not needed for the other locking mechanism 16, so that the open operation is needed only for the one locking mechanism 15. Therefore, the operability can further be improved.

After completing all the work of the maintenance check, in closing the panel door 6 finally, since the one locking mechanism 15 is in the locked state by the automatic locking operation according to the automatic closure of the panel door 6, only by the locking operation of the other locking mechanism 16 with the key, the panel door 6 can be locked surely by the locking mechanisms 15, 16.

Although the lower surface of the ceiling beam 2 or the upper surface of the horizontal beam 5 can be damaged by the contact with the tip of the lock pins 19 at the time of the opening/closing operation of the panel door 6, if the lock pins 19 of the locking mechanisms 15, 16 are to be engaged with the engaging parts formed flush with the lower surface of the ceiling beam 2 or the upper surface of the horizontal beam 5 directly, since the dedicated engaging member 30 is provided, projecting from the lower surface of the ceiling beam 2 and the upper surface of the horizontal beam 5 so that the lock pin 19 is engaged with the engaging member 30 in the present invention, the contact of the tip of the lock pin 19 with the lower surface of the ceiling beam 2 or the upper surface of the horizontal beam 5 can be prevented at the time of the opening/closing operation of the panel door 6, and thus damage on the lower surface of the ceiling beam 2 or the upper surface of the horizontal beam 5 can be prevented.

Figure 17:
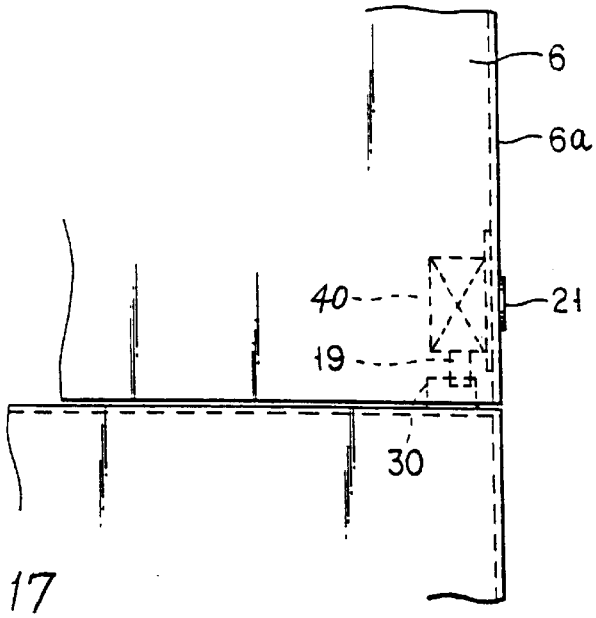
FIG. 17 is a side view of the mounting structure of the locking mechanism having a solenoid.

The present invention is not limited to the above-mentioned embodiments, but for example, a configuration wherein the locking mode of the two locking mechanisms 15, 16 can be switched selectively between the automatic locking structure with the panel door 6 automatically locked by the closing operation of the open panel door 6, and the manual locking structure with the panel door 6 locked manually, or a configuration wherein a mechanism operated by an electromagnetic means using a solenoid 40, or the like as shown in FIG. 17, is used as the locking mechanisms 15, 16, can be adopted as well.

Figure 18:
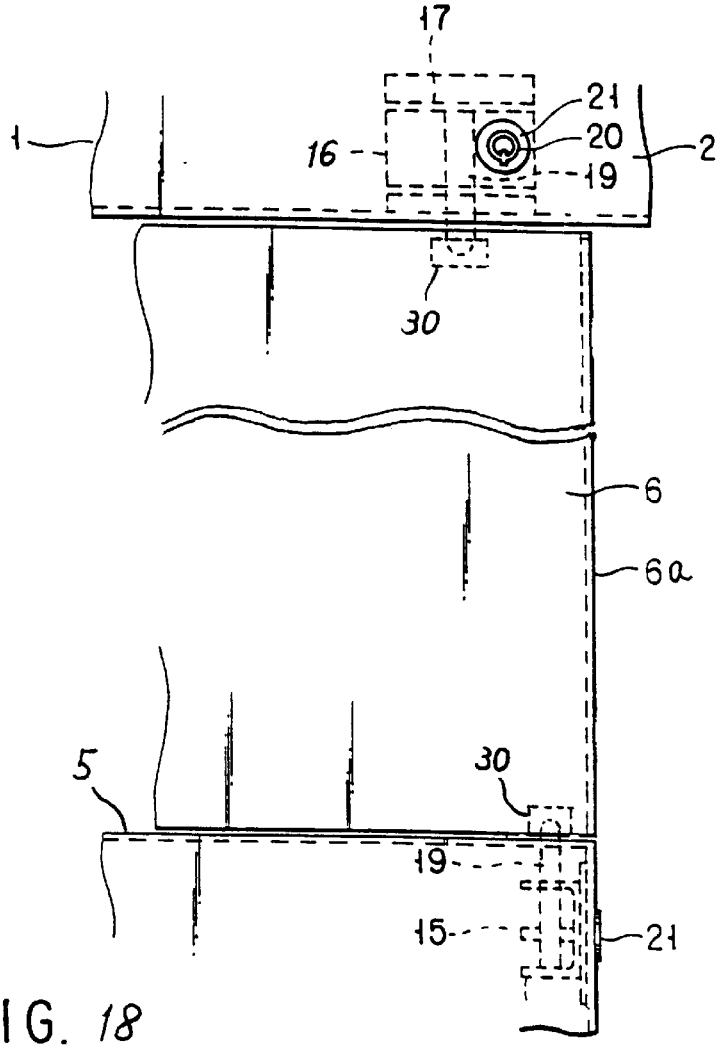
FIG. 18 is a side view of the mounting structure of the locking mechanism provided in a doorjamb.

Moreover, the locking mechanisms 15, 16 are not necessarily provided in the panel door 6, but can be provided in the doorjamb 1, which supports the panel door 6 for locking the panel door 6, as shown in FIG. 18. In this case, since a locking mechanism is not provided inside the panel door 6, an extra space can be provided inside the panel door 6, and thus the inner space of the panel door 6 can be utilized effectively by placing appliances or parts in the front side of the control panel 8.

Furthermore, if only the effective use of the inner space of the panel door 6 is targeted, a configuration wherein only one locking mechanism is provided at the doorjamb 1 side of the panel door 6 can be adopted.

According to the present invention heretofore explained, even if the panel door in the locked state is opened forcibly or handled violently, distortion or deformation of the panel door can be prevented. Moreover, the locking or opening operation of the panel door can be conducted easily and efficiently. Furthermore, the inconvenience of inadvertent opening of the panel door by a third person in the elevator maintenance check operation can be prevented.

Numerous modifications and variations of the present invention are possible in light of the above teachings. It is therefore to be understood that within the scope of the pending claims, the present invention may be practiced other than as specifically described herein.

What is claimed as new and desired to be secured by Letters Patent of the United States is:

1. An elevator control panel device, comprising:

an elevator control panel configured to be disposed in a doorjamb forming an entrance to the elevator in a building;

a panel door rotatably pivoted via a hinge at a hinge side of the panel door and providing access to the control panel;

an automatic closing mechanism configured to force the panel door in the closing direction so as automatically to close the panel door when the panel door is open; and at least one lock provided for locking the panel door at an opposite side of the panel door opposite to the hinge side of the panel door, comprising, a first member mounted on the panel door, and a second member configured to be mounted on the doorjamb, the first member being configured to engage the second member in a locked state automatically upon closing of the panel door.

2. The elevator control panel device according to claim 1, further comprising:

a biasing element configured to bias the first member in an outward direction.

3. The elevator control panel device according to claim 1, wherein:

the lock is provided inside the panel door and comprises a key mechanism including a key hole exposed to a side plate of the panel door.

4. The elevator control panel device according to claim 3, wherein:

the lock has a thickness smaller than the thickness of the panel door.

5. The elevator control panel device according to claim 1, wherein:

the first member is movable, and the lock comprises an electromagnetic device configured to move the first member.

6. The elevator control panel device according to claim 1, wherein:

the first member comprises a lock pin configured to be retracted and projected outwardly, and the second member comprises a dedicated engaging member mounted on the doorjamb and configured to engage with the lock pin by outward projection of the lock pin upon closing of the panel door.

7. The elevator control panel device according to claim 6, further comprising:

a biasing element configured to bias the lock pin outwardly, and a manually actuable key mechanism coupled to the lock pin and configured to retract the lock pin against the bias of the biasing element to permit opening of the panel door.

8. The elevator control panel device according to claim 7, wherein the lock pin comprises:

a tip end face notched with an inclined surface.

9. The elevator control panel device according to claim 8, wherein:

the orientation of the lock pin's inclined surface is changeable.

10. An elevator control panel device, comprising:

an elevator control panel configured to be disposed in a doorjamb forming an entrance to the elevator in a building;

a panel door rotatably pivoted via a hinge at a hinge side of the panel door and providing access to the control panel; and a pair of locks disposed at upper and lower portions of an opposite side of the panel door opposite the hinge side and provided for locking the panel door at the opposite side, at least one of the locks comprising a first member mounted on the panel door and a second member configured to be mounted on the doorjamb, the first member being configured to engage the second member in a locked state automatically upon closing of the panel door.

11. The elevator control panel device according to claim 10, further comprising:

a biasing element configured to bias the first member in an outward direction.

12. The elevator control panel device according to claim 10, wherein:

each of the locks is provided inside the panel door and comprises a key mechanism including a key hole exposed to a side plate of the panel door.

13. The elevator control panel device according to claim 12, wherein:

each of the locks has a thickness smaller than the thickness of the panel door.

14. The elevator control panel device according to claim 10, wherein:

the first member is movable, and at least one of the locks comprises an electromagnetic device configured to move the first member.

15. The elevator control panel device according to claim 10, wherein:

the first member comprises a lock pin configured to be retracted and projected outwardly, and the second member comprises a dedicated engaging member configured to be mounted on the doorjamb and configured to engage with the lock pin by outward projection of the lock pin upon closing of the panel door.

16. The elevator control panel device according to claim 15, further comprising:

a biasing element configured to bias the lock pin outwardly, and a manually actuable key mechanism coupled to the lock pin and configured to retract the lock pin against the bias of the biasing element to permit opening of the panel door.

17. The elevator control panel device according to claim 16, wherein the lock pin comprises:

a tip end face notched with an inclined surface.

18. The elevator control panel device according to claim 17, wherein:

the orientation of the lock pin's inclined surface is changeable.

19. The elevator control panel device according to claim 10, comprising:

said at least one lock further comprising a key mechanism configured to be disposed in the doorjamb for automatically locking the panel door at an opposite side of the panel door opposite to the hinge side of the panel door.

* * * * *